United States Patent [19]

Bratt

[11] 4,374,605

[45] Feb. 22, 1983

[54] AN ASSEMBLY OF AN ELECTRICAL CONNECTOR AND PYROTECHNIC IGNITER

[75] Inventor: Sven-Erik Bratt, Karlskoga, Sweden

[73] Assignee: Aktiebolaget Bofors, Bofors, Sweden

[21] Appl. No.: 183,671

[22] Filed: Sep. 2, 1980

[30] Foreign Application Priority Data

Sep. 3, 1979 [SE] Sweden ..... 7907293

[51] Int. Cl.[3] ..... H01R 13/658

[52] U.S. Cl. ..... 339/143 R; 339/147 R; 339/177 E

[58] Field of Search ..... 339/143 R, 147 R, 147 P, 339/177 E; 333/182, 183

[56] References Cited

U.S. PATENT DOCUMENTS

| | | | |
|---|---|---|---|
| 3,456,215 | 7/1969 | Denes | 333/182 |
| 3,825,874 | 7/1974 | Peverill | 339/147 R |
| 3,961,294 | 6/1976 | Hollyday | 339/147 R |
| 4,025,145 | 5/1977 | Shaffer et al. | 339/143R |
| 4,260,966 | 4/1981 | Boutros | 339/147 R |

FOREIGN PATENT DOCUMENTS

| | | | |
|---|---|---|---|
| 1157274 | 5/1958 | France | 339/177 E |
| 1488893 | 10/1977 | United Kingdom . | |

*Primary Examiner*—John McQuade

*Attorney, Agent, or Firm*—Pollock, Vande Sande & Priddy

[57] ABSTRACT

The present invention relates to an electric connector member to supply electrical energy into an electric igniter of the type which includes a priming charge ignitable by heat generated when feeding an electric current through the resistive element of the igniter and which igniter must be protected against accidental ignition caused by electromagnetic or static electricity which may enter into the igniter through the feed wires. Instead of providing the igniter itself with a high frequency filter, which requires a large space, the connector member is provided with such a filter (16, 17). This makes it possible to reduce the outer dimensions of the igniter to a great extent with the protection against accidental ignition maintained. Further the need to provide each of the igniters with a specific high frequency filter, designed for the expected interference condition in the actual application, does no more exist.

3 Claims, 3 Drawing Figures

AN ASSEMBLY OF AN ELECTRICAL CONNECTOR AND PYROTECHNIC IGNITER

The present invention relates to a connector member to supply electrical energy into an electric igniter of the type which includes a priming charge ignitable by heat generated when feeding an electric current through a resistive element of the igniter.

As described in British Pat. No. 1,488,893 it is known to protect an electric igniter against accidental ignition caused by electromagnetic fields and static electricity by enclosing the entire igniter in a casing which shields the igniter from electromagnetic energy and by providing the igniter with a high frequency filter which protects against electromagnetic fields and static electricity which enter the igniter through the feed wires.

In order to make room for the necessary capacitor and ferrite elements included in the high frequency filter the igniter is commonly provided with a voluminous part, a "cup," which substantially increases the outer dimensions of the igniter.

Another disadvantage with such an igniter is the fact that the high frequency filter portion makes the igniter more sensitive to shocks and other stresses which may occur for instance during transport. Especially in military applications when the igniters are commonly stored a considerable time before use, the risk of damage to the filter is increased.

As an igniter of this type can be used for a number of different applications, in which the interference conditions may differ considerably, it has proved to be impractical to provide each igniter with its own specific high frequency filter during the manufacture.

The purpose of the present invention is to provide a device which makes it possible to reduce the outer dimensions of an electric igniter of the above type to a great extent but with the protection against accidental ignition being maintained.

According to the invention the connector member for supplying electrical energy to the igniter is provided with a high frequency filter instead of the igniter itself. This means that only conventional igniters without filters need to be produced. No modifications of igniters intended to be used in applications with different interference conditions are required.

Accordingly, the main characterizing feature of our invention is that the electric igniter is protected against accidental ignition caused by electromagnetic fields and static electricity by using a connector member for supplying electrical energy to the igniter which member is enclosed in a metallic casing and comprises a high frequency filter.

Figure 1:
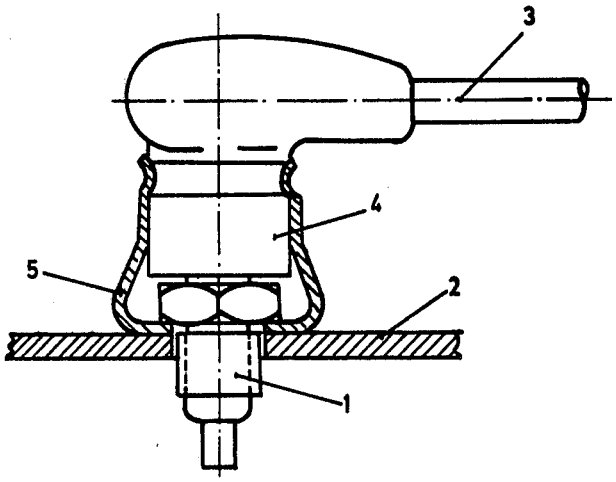
Figure 2:
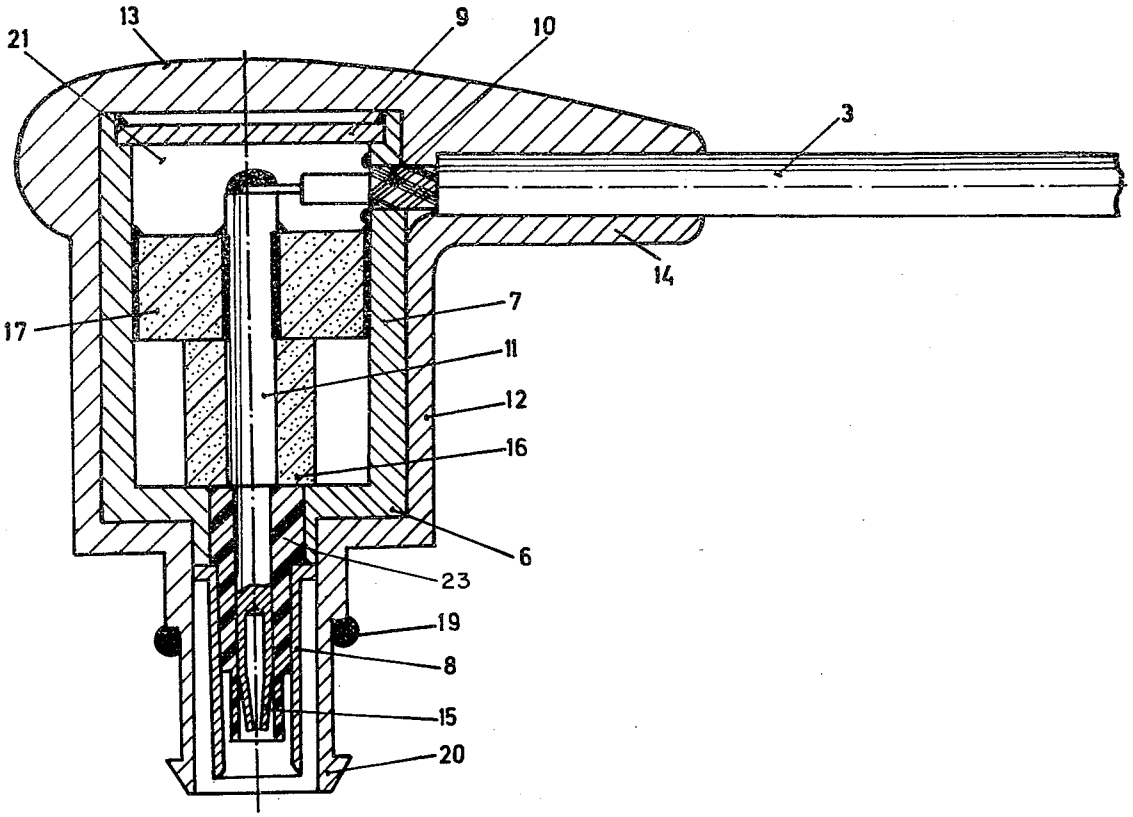

The invention will now be described in more detail, with reference to the attached drawings, in which FIG. 1 shows a schematic view of a connector member for an electric igniter mounted in a frame, FIG. 2 shows the mechanical design of the connector member and FIG. 3 the circuit diagram for the high frequency filter enclosed in the connector member.

The electric igniter shown in FIG. 1 may for instance be of the type disclosed in British Pat. No. 1,488,893, but without any high frequency filter or the type disclosed in British Patent Application No. 15512/78. The igniter may be used for starting a rocket motor in which case the igniter is constructed of material capable of resisting puncture under the pressure and temperature which will arise in the pressure vessel of the rocket motor during operation, but the igniter can also be used in many other applications in which a safe ignition is required. In FIG. 1 the igniter (1) is mounted in a frame 2 and electrical energy is supplied to the igniter via a shielded coaxial cable 3 and a connector member 4. The connector member is retained by means of a flanged portion 20 (see FIG. 2) and a spring clamp 5 and the connection is sealed by means of an O-ring 19 (see FIG. 2).

FIG. 2 shows more in detail the mechanical design of a connector member intended to be used in connection with an electric igniter of the type including a central connection leg or pin and a surrounding outer circular pole (coaxial type).

The connector member comprises an outer metallic, tubular casing 6 for instance made of steel or brass, having an upper wide part 7, the "cup," which comprises the high frequency filter components, and a low narrower part 8 used for connecting the outer, circular pole of the igniter. The casing comprises a metallic end closure 9 which is soldered onto the cup so that the entire connector member is encapsulated and high frequency electromagnetic radiation is prevented from passing into the connector.

The coaxial cable 3 is connected to the connector member via an opening 10 made in the cylindrical wall of the casing and the shield of the coaxial cable is soldered to the cup but its inner conductor is connected to the central pole 11 of the connector member. The entire metal casing is cast in an isolating material 12 with the portion surrounding the lower, narrower part 8 formed to permit fastening of the connector member to the igniter and which material is provided with a top closure 13 having a part 14 also enclosing the end of the coaxial cable. The soldering of the cable as well as the casting material 13, 14 relieve the cable but if required of course some type of clamping device can be used in addition thereto for unloading the cable. The central pole 11 of the connector member extends essentially through the entire connector and its lower part is provided with a spring sleeve contacting part 15 arranged to cooperate with the central connection leg or pin of the electric igniter. Insulation 23 is provided between narrower part 8 and contacting part 15.

As already mentioned the high frequency filter is enclosed in the cup 7 of the connector member. The filter comprises a conventional ferrite bead 16 and a capacitor 17, each provided with a central opening for the inner pole 11.

The capacitor 17 consists of one or more disc-shaped capacitor elements, chips, which can be mounted on each other in the cup 7, depending on the capacity requirements. The capacitor elements are preferably provided with discharging resistors, made of a thick film layer disposed directly on the element. The spacing 21 between the capacitor and the end closure 9 is preferably filled with an isolating material which material also serves as an unloading component for the cable 3.

Figure 3:
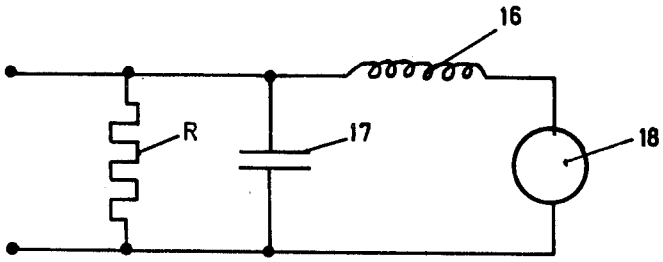

FIG. 3 shows the circuit diagram for a high frequency filter connected to the priming charge 18 of the electric igniter. As illustrated the ferrite bead 16 is connected in series with the priming charge and the capacitor 17 is connected parallel to the ferrite bead and the priming charge. The discharging resistor is connected parallel to the capacitor 17. The resistance value may for instance amount to 10–100k ohm and the capacitance of the capacitor 17 amounts to 1 $\mu$F or more.

I claim:

1. An assembly of an electrical connector for delivering current, and a pyrotechnic igniter for receiving said current, comprising:

an igniter element for igniting a primer charge, said igniter element having first and second concentric connection elements;

a connector for supplying an igniting current to said igniter element, comprising:

a metallic housing having a first opening for receiving a two conductor cable, one of said conductors being connected to said housing;

first and second concentric tubular connection elements attached to said housing, said tubular connection elements being adapted to mate with said igniter connection elements, one of said tubular elements being electrically connected with said housing and the other insulated therefrom; and a high frequency filter within said housing, said filter connecting the remaining of said conductors to the remaining of said tubular connection elements, whereby igniting current is supplied from said cable to said igniter and high frequency induced signals are inhibited from entering said igniter.

2. The assembly of claim 1 wherein said radio frequency filter comprises:

a disc capacitor having a central opening forming one electrode, and a second electrode on the periphery thereof connected to said housing, said capacitor including a resistive shunt member;

a conductor connecting said remaining tubular connector element through said disc capacitor opening to said remaining conductor; and a ferrite bead enclosing a portion of said conductor between said remaining tubular connector element and said disc capacitor.

3. The assembly of claim 2 further comprising:

a casting material covering said connector, said casting material having an opening for said cable and an opening at said tubular connection elements.

* * * * *